US008669219B2

(12) United States Patent
Wiedemann et al.

(10) Patent No.: US 8,669,219 B2
(45) Date of Patent: Mar. 11, 2014

(54) DOSAGE ELEMENT AND A METHOD OF MANUFACTURING A DOSAGE ELEMENT

(75) Inventors: Ralf Wiedemann, Mira (IT); Pavlinka Roy, Ludwigshafen (DE); Frederic Moreux, Barcelona (ES)

(73) Assignee: Reckitt Benckiser N.V., Hoofddorp (NL)

( * ) Notice: Subject to any disclaimer, the term of this patent is extended or adjusted under 35 U.S.C. 154(b) by 583 days.

(21) Appl. No.: 12/523,561

(22) PCT Filed: Jan. 17, 2008

(86) PCT No.: PCT/GB2008/000153
§ 371 (c)(1),
(2), (4) Date: Dec. 15, 2009

(87) PCT Pub. No.: WO2008/087414
PCT Pub. Date: Jul. 24, 2008

(65) Prior Publication Data

US 2010/0101612 A1 Apr. 29, 2010

(30) Foreign Application Priority Data

Jan. 18, 2007 (GB) ..... 0700920.2

(51) Int. Cl.
*C11D 11/00* (2006.01)
*B65B 5/06* (2006.01)

(52) U.S. Cl.
USPC ..... 510/293; 510/296; 510/439; 53/433; 53/443; 53/453

(58) Field of Classification Search
USPC ..... 134/25.2, 42; 53/433, 453, 443; 510/293, 296, 439; 264/454, 571; 206/427
See application file for complete search history.

(56) References Cited

U.S. PATENT DOCUMENTS

2008/0248989 A1 10/2008 Holderbaum

FOREIGN PATENT DOCUMENTS

| | | | | |
|---|---|---|---|---|
| DE | 202004005446 | U1 | | 8/2005 |
| DE | 20-2004-005446 | | * | 9/2005 |
| DE | 102006031337 | A1 | | 1/2007 |
| EP | 1506925 | A1 | | 2/2005 |
| EP | 1679362 | A1 | | 7/2006 |
| GB | 2374581 | | * | 4/2001 |
| GB | 2374580 | A | | 10/2002 |

(Continued)

OTHER PUBLICATIONS

English Language Abstract for DE202004005446 translated by Google Translate.

(Continued)

*Primary Examiner* — Saeed T Chaudhry
(74) *Attorney, Agent, or Firm* — Norris McLaughlin & Marcus PA

(57) ABSTRACT

This invention concerns dosage elements for a ware washing machine and a method of manufacturing such dosage elements. In embodiments of the invention a dosage element comprises first (10) and second (20) joined parts, wherein the first part (10) is a part which, prior to joining with the second part (20), comprised an open receptacle and wherein the second part (20) comprises a substrate carrying a plurality of mutually separated substances A, B, C arranged in side by side relation. The second part (20) is joined to said first part (10) so as to close said receptacle and enclose said substances within it. Dosage elements produced in the inventive method are pleasant to handle, while being surprisingly resistant to damage in handling or transit.

14 Claims, 1 Drawing Sheet

(56) References Cited

FOREIGN PATENT DOCUMENTS

| | | | |
|---|---|---|---|
| GB | 2374581 | A | 10/2002 |
| GB | 2390840 | A | 1/2004 |
| GB | 2428227 | A | 1/2007 |
| WO | 0185898 | A1 | 11/2001 |
| WO | 0208380 | A1 | 1/2002 |
| WO | 0242408 | A2 | 5/2002 |
| WO | 2004014753 | A1 | 8/2003 |
| WO | 03072694 | A1 | 9/2003 |
| WO | 2004103849 | A1 | 12/2004 |
| WO | 2005121302 | A1 | 12/2005 |
| WO | 2005123511 | A1 | 12/2005 |
| WO | 2007116357 | A2 | 10/2007 |

OTHER PUBLICATIONS

English language abstract of DE102006031337 found on esp@cenet.com, Jan. 11, 2007.

English language abstract of EP1506925 found on esp@cenet.com, Feb. 16, 2005.

* cited by examiner

DOSAGE ELEMENT AND A METHOD OF MANUFACTURING A DOSAGE ELEMENT

This is an application filed under 35 USC 371 of PCT/GB2008/000153.

The invention relates to a dosage element for a ware washing machine and to a method of manufacture thereof.

Ware washing machines, such as automatic clothes washing and dishwashing machines, typically utilise detergents and other additives in solid, liquid or powder form. These substances are either administered directly into the machine, or dispensed via a tray or a dedicated compartment system to be added to the washing area at the start of, or during, a washing cycle.

Often, the required detergents/additives are administered as a compound tablet comprising a plurality of active ingredients. These may be kept separate for reasons of incompatibility. Alternatively or additionally they may be kept separate so that they may be activated at different points during a washing cycle or rinsing cycle. This activation at a particular point may be achieved by including time and/or temperature dependent released elements within the composition. One technique involves the coating or encasing of individual active components of the compound tablet within a water soluble polymer or gel of given properties/thickness to provide a time delayed and/or temperature dependent exposure to the component within so that it is exposed to the wash liquor within the ware washing machine at the desired point in a cycle.

In compound dosage elements of the type described above, individual active components may be in any state such as a solid, particulate or liquid form.

With the need to accommodate perhaps three or four active components within a single convenient dosage element, comes the complication of isolating each component from its neighbour and providing the dosage form within an overall compact package. These issues lead to complications within the manufacturing process and an increase in the costs of production. Accordingly, it is one aim of preferred embodiments of the present invention to provide a relatively simple dosage element formation and uncomplicated method of construction.

Consumers are becoming increasingly reluctant to handle detergent compositions directly as there are perceived health/hygiene issues to doing so. With this in mind, it is desired to provide a barrier between the hand of the consumer and the ingredients of the dosage element and to reduce the risks of inadvertent exposure of the consumer to active ingredients of the dosage elements.

According to a first aspect of the invention, there is provided a dosage element to be consumed in use in a ware washing machine, the dosage element comprising first and second joined parts, wherein the first part is a part which, prior to joining with the second part, comprised an open receptacle and wherein the second part comprises a substrate carrying a plurality of substances arranged in side by side relation, and wherein the second part is joined to said first part so as to close said receptacle and enclose said substances within it.

In the present invention the dosage element is suitably consumed in a washing cycle, in the sense that at the end of cycle no part of it has to be removed from the machine; indeed, preferably, no part of it can be discerned, within the machine.

Suitable the first part and the substrate of the second part are of water-soluble materials.

Water-soluble herein includes water-dispersible.

Preferably the plurality of substances are mutually separated on the substrate of the second part.

Preferably the first part is empty and substantially the entire active washing content of the dosage element is conveyed to the dosage element via the second part.

Suitably, said first part and said second part are brought together during a manufacturing step in which said first part covers said substances and causes spaces between said substances to be substantially taken up by said substances, coming together under compressive forces.

In one variation said second part comprises a plurality of cores of said substances adhered to said substrate in spaced apart relation.

In a second variation said second part comprises a plurality of compartments supported by said substrate and, each of which compartments contains one of said plurality of substances. Preferably, said second part comprises first and second elements, wherein said second element comprises a multi-compartment pocket for receiving a substance in each compartment thereof and wherein said first element closes said pocket to contain each substance within its respective compartment. Here, said first part and said second part may be relatively flexible in isolation, but when joined to one another the dosage element formed is relatively rigid.

Preferably, said first part is made by thermo-forming a water-soluble sheet or film, but could be formed by injection moulding.

Preferably, said second part is made by thermo-forming a water-soluble sheet or film, but could be formed by injection moulding.

Optionally, the dosage element may include a third part comprising a water-soluble lid, preferably a film, applied over the second part to close the compartments.

Preferably each of the first and second parts are of a material which is flexible, in the sense that when subjected to a deflecting force it does not generate a force acting to restore it to its previous position or shape (as would a "flexible" plastics ruler). Preferably the lid-forming part is a film (by which we mean to include herein a foil).

Each of the first and second parts may have a peripheral region, and the peripheral regions are arranged face-to-face when the parts are brought together for closing of the receptacle. These regions are suitably the means by which the first and second parts are joined. They are sealed to each other face-to-face, in the finished dosage element. As a result the dosage form preferably has a peripheral skirt, which represents the region in which the first and second parts are joined.

The two parts (and the second part and the lid, when present) may be sealed together by means of an adhesive, preferably an aqueous liquid, preferably a PVOH solution or water. The adhesive may be applied to one of both peripheral regions. Alternatively they may be sealed together by heat sealing. Other methods of sealing include infra-red, radio frequency, ultrasonic, laser, solvent (such as water), vibration and spin welding. If heat sealing is used, a suitable sealing temperature is for example 125° C. A suitable sealing pressure is readily selected by the person skilled in the art.

Preferably, the walls of, or within, the dosage element are of film or sheet material having a thickness of between 30 and 600 μm. When thermoforming is used, the thickness is preferably in the range 30-250 μm, preferably 40-200 μm, preferably 50-150 μm. When injection moulding is used, the thickness is preferably in the range 200-600 μm, preferably 240-600 μm preferably 250-400 μm.

Suitable water-soluble polymeric materials for use in this invention are such that discs of 100 μm thickness and 30 mm diameter dissolve in 5 liters of water maintained at 50° C., under gentle stirring, in less than 30 minutes.

A water-soluble polymeric material for use herein may suitably be selected from the group comprising polyvinyl alcohols, polyvinyl alcohol copolymers, partially hydrolyzed polyvinyl acetates, cellulose derivatives (such as alkylcelluloses, hydroxyalkylcelluloses, salts, ethers and esters of alkylcelluloses and hydroxyalkylcelluloses, for example, hydroxypropylcellulose, hydroxypropylmethyl-cellulose and sodium carboxymethylcellulose); polyglycolides, polyglycolic acids, polylactides, polylactic acids; polyvinyl pyrrolidines, polyacrylic acids or salts or esters thereof, polymaleic acids or salts or esters thereof, dextrins, maltodextrins, polyacrylamides, acrylic acid/maleic anhydride copolymers, including copolymers (which includes terpolymers), and blends. Optionally fillers, plasticisers and process aids may also be comprised in the formulation of a water-soluble polymeric material for use herein.

Preferred polymeric materials for are selected from the group comprising polyvinyl alcohols, polyvinyl alcohol copolymers, and partially hydrolyzed polyvinyl acetates. An especially preferred water-soluble polymeric material comprises a poly(vinyl alcohol).

Preferably the dosage element is not of squared-off, cuboid appearance and/or is preferably not rigid. Preferably is not box-like, in look or feel. Preferably it is of somewhat rounded, preferably pillow-like appearance, and/or is of compliant or "squashy" feel.

A preferred dosage form of the invention is a laundry washing tablet or, most preferably, a dishwashing tablet. We use the term tablet here to denote a body which can be handled by a consumer as a discrete element, for example as a unit dose. Preferably the first and second substances comprise laundry detergent compositions, or, especially, dishwashing detergent compositions.

Preferred components of a dishwashing tablet are as follows:

Bleaching Compounds

Any type of bleaching compound conventionally used in detergent compositions may be used according to the present invention. Preferably the bleaching compound is selected from inorganic peroxides or organic peracids, derivatives thereof (including their salts) and mixtures thereof. Especially preferred inorganic peroxides are percarbonates, perborates and persulphates with their sodium and potassium salts being most preferred. Sodium percarbonate and sodium perborate are most preferred, especially sodium percarbonate.

Organic peracids include all organic peracids traditionally used as bleaches, including, for example, perbenzoic acid and peroxycarboxylic acids such as mono- or diperoxyphthalic acid, 2-octyldiperoxysuccinic acid, diperoxydodecanedicarboxylic acid, diperoxy-azelaic acid and imidoperoxycarboxylic acid and, optionally, the salts thereof. Especially preferred is phthalimidoperhexanoic acid (PAP).

Desirably the bleaching compound is present in the compositions in an amount of from 1 to 60 wt %, especially 5 to 55 wt %, most preferably 10 to 50% wt, such as 10 to 20% wt. When the compositions of the invention comprise two or more distinct regions, the amount of bleaching compound typically present in each can be chosen as desired although the total amount of the bleaching compound will typically be within the amounts stated hereinabove.

Builders

The detergent compositions may also comprise conventional amounts of detergent builders which may be either phosphorous based or non-phosphorous based, or even a combination of both types. Suitable builders are well known in the art.

If phosphorous builders are to be used then it is preferred that mono-phosphates, di-phosphates, tri-polyphosphates or oligomeric-polyphosphates are used. The alkali metal salts of these compounds are preferred, in particular the sodium salts. An especially preferred builder is sodium tripolyphosphate (STPP).

The non-phosphorous based builder may be organic molecules with carboxylic group(s), amino acid based compound or a succinate based compound. The term 'succinate based compound' and 'succinic acid based compound' are used interchangeably herein.

Builder compounds which are organic molecules containing carboxylic groups include citric acid, fumaric acid, tartaric acid, maleic acid, lactic acid and salts thereof. In particular the alkali or alkaline earth metal salts of these organic compounds may be used, and especially the sodium salts. An especially preferred builder is sodium citrate.

Preferred examples of amino acid based compounds according to the invention are MGDA (methyl-glycine-diacetic acid, and salts and derivatives thereof) and GLDA (glutamic-N,N-diacetic acid and salts and derivatives thereof). GLDA (salts and derivatives thereof) is especially preferred according to the invention, with the tetrasodium salt thereof being especially preferred. Other suitable builders are described in U.S. Pat. No. 6,426,229 which is incorporated by reference herein. Particular suitable builders include; for example, aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl)aspartic acid (SMAS), N-(2-sulfoethyl)aspartic acid (SEAS), N-(2-sulfomethyl)glutamic acid (SMGL), N-(2-sulfoethyl)glutamic acid (SEGL), N-methyliminodiacetic acid (MIDA), α-alanine-N,N-diacetic acid (α-ALDA), β-alanine-N,N-diacetic acid (β-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts or ammonium salts thereof.

Further preferred succinate compounds are described in U.S. Pat. No. 5,977,053 and have the formula;

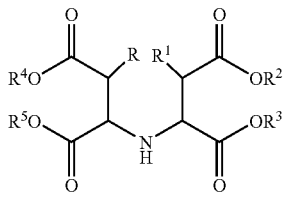

in which R, $R^1$, independently of one another, denote H or OH, $R^2$, $R^3$, $R^4$, $R^5$, independently of one another, denote a cation, hydrogen, alkali metal ions and ammonium ions, ammonium ions having the general formula $R^6R^7R^8R^9N+$ and $R^6$, $R^7$, $R^8$, $R^9$, independently of one another, denoting hydrogen, alkyl radicals having 1 to 12 C atoms or hydroxyl-substituted alkyl radicals having 2 to 3 C atoms. A preferred example is tetrasodium imminosuccinate.

Preferably the total amount of builder present in the compositions of the invention is an amount of at least 5 wt %, preferably at least 10 wt %, more preferably at least 20 wt %, and most preferably at least 25 wt %, preferably in an amount of up to 70 wt %, preferably up to 65 wt %, more preferably up to 60 wt %, and most preferably up to 35 wt %. The actual amount used will depend upon the nature of the builder used.

The detergent compositions of the invention may further comprise a secondary builder (or cobuilder). Preferred secondary builders include homopolymers and copolymers of polycarboxylic acids and their partially or completely neutralized salts, monomeric polycarboxylic acids and hydroxycarboxylic acids and their salts, phosphates and phosphonates, and mixtures of such substances. Preferred salts of the abovementioned compounds are the ammonium and/or alkali metal salts, i.e. the lithium, sodium, and potassium salts, and particularly preferred salts is the sodium salts.

Secondary builders which are organic are preferred.

Suitable polycarboxylic acids are acyclic, alicyclic, heterocyclic and aromatic carboxylic acids, in which case they contain at least two carboxyl groups which are in each case separated from one another by, preferably, no more than two carbon atoms.

Polycarboxylates which comprise two carboxyl groups include, for example, water-soluble salts of, malonic acid, (ethylenedioxy)diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid.

Another suitable polycarboxylic acid is the homopolymer of acrylic acid. Other suitable builders are disclosed in WO 95/01416, to the contents of which express reference is hereby made.

Surfactants

The detergent compositions of the invention may contain surface active agents, for example, anionic, cationic, amphoteric or zwitterionic surface active agents or mixtures thereof. Many such surfactants are described in Kirk Othmer's Encyclopedia of Chemical Technology, 3rd Ed., Vol. 22, pp. 360-379, "Surfactants and Detersive Systems", incorporated by reference herein. In general, bleach-stable surfactants are preferred.

A preferred class of nonionic surfactants is ethoxylated non-ionic surfactants prepared by the reaction of a monohydroxy alkanol or alkylphenol with 6 to 20 carbon atoms. Preferably the surfactants have at least 12 moles particularly preferred at least 16 moles, and still more preferred at least 20 moles of ethylene oxide per mole of alcohol or alkylphenol.

Particularly preferred non-ionic surfactants are the non-ionics from a linear chain fatty alcohol with 16-20 carbon atoms and at least 12 moles particularly preferred at least 16 and still more preferred at least 20 moles of ethylene oxide per mole of alcohol.

According to one embodiment of the invention, the non-ionic surfactants additionally may comprise propylene oxide units in the molecule. Preferably these PO units constitute up to 25% by weight, preferably up to 20% by weight and still more preferably up to 15% by weight of the overall molecular weight of the non-ionic surfactant.

Surfactants which are ethoxylated mono-hydroxy alkanols or alkylphenols, which additionally comprises polyoxyethylene-polyoxypropylene block copolymer units may be used. The alcohol or alkylphenol portion of such surfactants constitutes more than 30%, preferably more than 50%, more preferably more than 70% by weight of the overall molecular weight of the non-ionic surfactant.

Another class of suitable non-ionic surfactants includes reverse block copolymers of polyoxyethylene and polyoxypropylene and block copolymers of polyoxyethylene and polyoxypropylene initiated with trimethylolpropane.

Another preferred class of nonionic surfactant can be described by the formula:

$$R^1O[CH_2CH(CH_3)O]_x[CH_2CH_2O]_y[CH_2CH(OH)R^2]$$

where $R^1$ represents a linear or branched chain aliphatic hydrocarbon group with 4-18 carbon atoms or mixtures thereof, $R^2$ represents a linear or branched chain aliphatic hydrocarbon rest with 2-26 carbon atoms or mixtures thereof, x is a value between 0.5 and 1.5 and y is a value of at least 15.

Another group of preferred nonionic surfactants are the end-capped polyoxyalkylated non-ionics of formula:

$$R^1O[CH_2CH(R^3)O]_x[CH_2]_kCH(OH)[CH_2]_jOR^2$$

where $R^1$ and $R^2$ represent linear or branched chain, saturated or unsaturated, aliphatic or aromatic hydrocarbon groups with 1-30 carbon atoms, $R^3$ represents a hydrogen atom or a methyl, ethyl, n-propyl, iso-propyl, n-butyl, 2-butyl or 2-methyl-2-butyl group, x is a value between 1 and 30 and, k and j are values between 1 and 12, preferably between 1 and 5. When the value of x is >2 each $R^3$ in the formula above can be different. $R^1$ and $R^2$ are preferably linear or branched chain, saturated or unsaturated, aliphatic or aromatic hydrocarbon groups with 6-22 carbon atoms, where group with 8 to 18 carbon atoms are particularly preferred. For the group $R^3H$, methyl or ethyl are particularly preferred. Particularly preferred values for x are comprised between 1 and 20, preferably between 6 and 15.

As described above, in case x>2, each $R^3$ in the formula can be different. For instance, when x=3, the group $R^3$ could be chosen to build ethylene oxide ($R^3$=H) or propylene oxide ($R^3$=methyl) units which can be used in every single order for instance (PO)(EO)(EO), (EO)(PO)(EO), (EO)(EO)(PO), (EO)(EO)(EO), (PO)(EO)(PO), (PO) (PO) (EO) and (PO) (PO)(PO). The value 3 for x is only an example and bigger values can be chosen whereby a higher number of variations of (EO) or (PO) units would arise.

Particularly preferred end-capped polyoxyalkylated alcohols of the above formula are those where k=1 and j=1 originating molecules of simplified formula:

$$R^1O[CH_2CH(R^3)O]_xCH_2CH(OH)CH_2OR^2$$

The use of mixtures of different nonionic surfactants is suitable in the context of the present invention, for instance, mixtures of alkoxylated alcohols and hydroxy group containing alkoxylated alcohols.

Other suitable surfactants are disclosed in WO 95/01416, to the contents of which express reference is hereby made.

Preferably the non-ionic surfactants are present in the compositions of the invention in an amount of from 0.1% wt to 5% wt, more preferably 0.5% wt to 3% wt, such as 0.5 to 3% wt.

The surfactants are typically included in amounts of up to 15% wt, preferably of from 0.5% wt to 10% wt, such as 1% wt to 5% wt in total.

Anti-Foam Agents

The detergent composition according to the invention may comprise one or more foam control agents. Suitable foam control agents for this purpose are all those conventionally used in this field, such as, for example, silicones and paraffin oil. If present, the foam control agents are preferably present in the composition in amounts of 5% by weight or less of the total weight of the composition.

Anti-Corrosion Agents

It is known to include a source of multivalent ions in cleaning compositions, and in particular in automatic dishwashing compositions, for technical and/or performance reasons. For example, multivalent ions and especially zinc and/or manganese ions have been included for their ability to inhibit corrosion on metal and/or glass. Bismuth ions may also have benefits when included in such compositions.

For example, organic and inorganic redox-active substances which are known as suitable for use as silver/copper corrosion inhibitors are mentioned in WO 94/26860 and WO 94/26859. Suitable inorganic redox-active substances are, for example, metal salts and/or metal complexes chosen from the group consisting of zinc, manganese, titanium, zirconium, hafnium, vanadium, cobalt and cerium salts and/or complexes, the metals being in one of the oxidation states II, III, IV, V or VI. Particularly suitable metal salts and/or metal complexes are chosen from the group consisting of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$ and $Ce(NO_3)_3$. Zinc salts are specially preferred corrosion inhibitors.

Therefore, an especially preferred optional ingredient according to the present invention is a source of multivalent ions such as those mentioned in the immediately preceding paragraph and in particular zinc, bismuth and/or manganese ions. In particular a source of zinc ions is preferred. Any suitable source of multivalent ions may be used, with the source preferably being chosen from sulphates, carbonates, acetates, gluconates and metal-protein compounds and those mentioned in the immediately preceding paragraph.

Any conventional amount of multivalent ions/multivalent ions source may be included in the compositions of the invention. However, it is preferred that the multivalent ions are present in an amount of from 0.01% wt to 5% wt, preferably 0.1% wt to 3% wt, such as 0.5% wt to 2.5% wt. The amount of multivalent ion source in the compositions of the invention will thus be correspondingly higher.

The detergent composition may also comprise a silver/copper corrosion inhibitor in conventional amounts. This term encompasses agents that are intended to prevent or reduce the tarnishing of non-ferrous metals, in particular of silver and copper. Preferred silver/copper corrosion inhibitors are benzotriazole or bis-benzotriazole and substituted derivatives thereof. Other suitable agents are organic and/or inorganic redox-active substances and paraffin oil. Benzotriazole derivatives are those compounds in which the available substitution sites on the aromatic ring are partially or completely substituted. Suitable substituents are linear or branch-chain $C_{1-20}$ alkyl groups and hydroxyl, thio, phenyl or halogen such as fluorine, chlorine, bromine and iodine. A preferred substituted benzotriazole is tolyltriazole.

Performance Polymers

Polymers intended to improve the cleaning performance of the detergent compositions may also be included therein. For example sulphonated polymers may be used. Preferred examples include copolymers of $CH_2{=}CR^1{-}CR^2R^3{-}O{-}C_4H_3R^4{-}SO_3X$ wherein $R^1$, $R^2$, $R^3$, $R^4$ are independently 1 to 6 carbon alkyl or hydrogen, and X is hydrogen or alkali with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Other suitable sulfonated monomers for incorporation in sulfonated (co)polymers are 2-acrylamido-2-methyl-1-propanesulfonic acid, 2-methacrylamido-2-methyl-1-propanesulfonic acid, 3-methacrylamido-2-hydroxypropanesulfonic acid, allysulfonic acid, methallysulfonic acid, 2-hydroxy-3-(2-propenyloxy)propanesulfonic acid, 2-methyl-2-propenen-1-sulfonic acid, styrenesulfonic acid, vinylsulfonic acid, 3-sulfopropyl acrylate, 3-sulfopropylmethacrylate, sulfomethylacrylamide, sulfomethylmethacrylamide and water soluble salts thereof. Suitable sulfonated polymers are also described in U.S. Pat. No. 5,308,532 and in WO 2005/090541.

When a sulfonated polymer is present, it is preferably present in the composition in an amount of at least 0.1 wt %, preferably at least 0.5 wt %, more preferably at least 1 wt %, and most preferably at least 3 wt %, up to 40 wt %, preferably up to 25 wt %, more preferably up to 15 wt %, and most preferably up to 10 wt %.

Enzymes

The detergent composition of the invention may comprise one or more enzymes. It is preferred that the enzyme is selected from protease, lipase, amylase, cellulase and peroxidase enzymes. Such enzymes are commercially available and sold, for example, under the registered trade marks Esperase, Alcalase and Savinase by Nova Industries A/S and Maxatase by International Biosynthetics, Inc. It is most preferred that protease enzymes are included in the compositions according to the invention; such enzymes are effective for example in dishwashing detergent compositions.

Desirably enzyme(s) is/are present in the composition in an amount of from 0.01 to 3 wt %, especially 0.1 to 2.5 wt %, such as 0.2 to 2 wt %.

Buffering Systems

The detergent composition according to the invention may comprise a buffering system to maintain the pH of the composition at a desired pH on dissolution and this may comprise a source of acidity or a source of alkalinity as necessary.

A source of acidity may suitably be any components which are acidic; for example polycarboxylic acids. Citric acid is especially preferred. Salts of these acids may also be used. A source of alkalinity may suitably be any suitable compound which is basic; for example any salt of a strong base and a weak acid such as soda. However additional acids or bases may be present. In the case of alkaline compositions silicates, phosphates or hydrogen phosphates may suitably be used. Preferred silicates are sodium silicates such as sodium disilicate, sodium metasilicate and crystalline phyllosilicates.

Perfume, Colours, Preservatives

The detergent compositions of the invention may also comprise minor, conventional amounts of perfumes, preservatives and/or colourants. Such ingredients are typically present in amounts of up to 2% wt.

Contrasting Parts

Preferred dosage forms have first and second parts which contrast with each other. They may contrast in the chemical nature of their components. The components may have different functions in a ware washing environment. They may be incompatible with each other. For example one component may interact adversely with another component to cause instability in storage or to reduce effective cleaning action, and such components may be segregated, one in the first part and one in the second part.

Alternatively or additionally the first and second parts may be arranged to release their components at different times in the washing process. This may be achieved by use of different coverings or skins for the components; for example by use of different wall materials for the first and second parts, with different rates of dissolution in the wash water and/or by use of walls of different thicknesses for the first and second parts.

Alternatively or additionally it may facilitate manufacture to separate certain components, and thereby create a contrast between the first and second parts.

Alternatively or additionally the first and second parts may contrast in their properties for aesthetic reasons. The following are examples of contrasting first and second parts:

an enzyme in one part and a bleach in another part;

a corrosion inhibitor in one part and a bleach in another part;

a corrosion inhibitor in one part and an enzyme in another part;

an acid or a hydrolysable agent in one part and an alkalinity agent in another part;

a solid (including a powder or a gel) in one part and a liquid in another part;

a solid (including a powder or a gel) in one part and another solid (including a powder or a gel) in another part, to be kept apart, whether for chemical/functional reasons or aesthetic reasons;

a liquid in one part and another liquid in another part, to be kept apart, whether for chemical/functional reasons or aesthetic reasons;

a pre-wash formulation (including a ware washing machine cleaner, for example machine sanitizer and/or descaler), in one part and a main wash formulation in another part;

a main wash formulation in one part and a rinse aid formulation in another part.

Preferably the weight of the dosage element is up to 34 g, preferably up to 30 g.

Preferably the weight of the dosage element is at least 4 g, preferably at least 10 g, preferably at least 14 g.

Preferably the ratio by weight of the said substances contained in the dosage element to the total water-soluble polymeric material(s) (the sum thereof making up the total weight of the dosage element) is in the range 10:1 to 100:1, preferably 16:1 to 60:1, preferably 24:1 to 40:1.

Preferably the weight of the total water-soluble polymeric material(s) is at least 0.1 g, preferably at least 0.2 g, preferably at least 0.3 g.

Preferably the weight of the total water-soluble polymeric material(s) is up to 2 g, preferably up to 1 g, preferably up to 0.7 g.

The dosage element as described above provides a very convenient and compact arrangement that is easy to manufacture, of attractive appearance and resistant to bending and other stress. It is an important advantage of this invention that the dosage element is stable and relatively stress-free and stress-resistant. The spatial relationship of the substances means that they provide mutual support, and resistance to bending. The dosage element is preferably made with spaces between the substances. This is convenient for manufacture, and the spaces collapse during assembly, leading to space efficiency and mutual support. Potential weak spots (which may be at corners or radiused portions of compartment walls) are supported against rupture, so reducing damage in handling or transit.

According to a second aspect of the invention, there is provided a method of manufacturing a dosage element to be consumed in use in a ware washing machine, the method comprising:

(a) forming a first part into an open receptacle;

(b) forming a second part into a substrate carrying a plurality of substances arranged in side by side relation; and (c) closing said open receptacle of said first part by joining the first and second parts to one another so as to enclose said substances within said first and second parts.

Step (a) may comprise forming a sheet or film within a cavity of a mould; preferably by thermoforming.

Preferably, said step (b) comprises the sub-steps of: (b1) forming a multi-chambered pocket; (b2) introducing said substances to chambers of said pocket; and (b3) closing said chambers with a lid, preferably with the pocket still in the mould.

Said step (b1) may comprise forming a sheet or film within a cavity of a mould; preferably by thermoforming.

Preferably, in said step (b3) said chambers are closed by sealing the lid to said multi-chambered pocket.

Preferably the thicknesses of the sheet or film used herein for forming the first and second parts, and of the lid, are in the range of 60 to 120 μm.

Preferably, the mould geometry for forming said first part is designed such that the first part forms a chamber able to tightly embrace the substances carried by the second part.

Thus, preferably, said step (c) comprises adding and tightly placing the intermediate product formed of said second part to the mould of the first part.

Preferably, in said step (c) the first part is sealed to the second part.

Each of the first and second parts may have a peripheral region, and the peripheral regions are arranged face-to-face when the parts are brought together for closing of the receptacle. These regions are preferably the means by which the first and second parts are sealed.

On assembly of the dosage element the substances carried by the second part are placed fully within the receptacle of the first part; and the peripheral regions are now face-to-face. The peripheral regions are sealed together. As a result the dosage form preferably has a peripheral skirt, which represents the region in which the first and second parts are joined.

The sealing of parts—first part to second part, or lid to second part, may be by means of an adhesive, which may be water or a solution or a water-soluble polymer in water, or by heat sealing or by other methods of sealing such as infra-red, radio frequency, ultrasonic, laser, solvent (such as water), vibration or spin welding.

Preferably, a mould comprises a plurality of cavities for forming a plurality of first parts at one time.

Preferably, a second mould comprises a plurality of cavities for forming a plurality of second parts at one time.

The method preferably comprises the step of separating the completed dosage elements into individual dosage elements or into groups of dosage elements, for example 4-16 in number, which are packaged in such groups and are intended to be separated into individual dosage elements by the user.

After the steps described above the dosage elements may be packaged.

Preferably the steps described above define the manufacturing method fully; that is, there is preferably no further substantive manufacturing step. In particular there is for example preferably no step of setting the dosage elements face-to-face, for example by folding.

In a variation to the method of the second aspect, said step (b) comprises adhering individual cores of said substances to a substrate in spaced apart relation.

The dosage element of the first aspect need not be made by the method of the second aspect. Nevertheless preferred aspects defined with reference to the second aspect may (unless not possible) be regarded as preferred aspects of the first aspect whether or not made by the method of the second aspect; and vice-versa.

However, the dosage element of the first aspect is preferably made by the method of the second aspect. In a third aspect of the invention there is provided a dosage element made by a method of the second aspect.

According to a fourth aspect there is provided a method of ware washing in a machine, preferably a method of washing kitchenware in a dishwashing machine, using a dosage element of the first aspect, or a dosage element of the third aspect. In this method the dosage element is wholly consumed in one wash cycle.

For a better understanding of the invention, and to show how embodiments of the same may be carried into effect, reference will now be made, by way of example, to the accompanying diagrammatic drawings in which:

FIG. 1(*b*) is a schematic diagram showing the container of FIG. 1(*a*) as the parts are brought together;

Figure 1A:
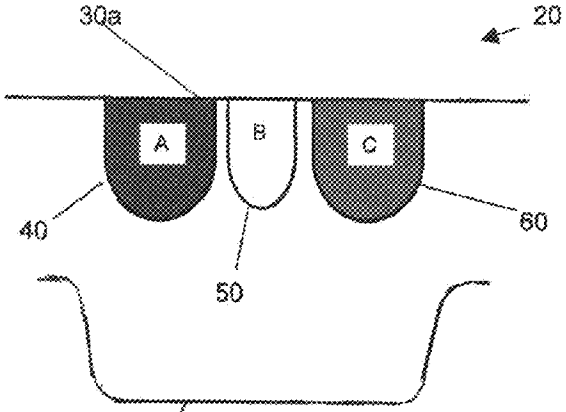
FIG. 1(*a*) is a schematic diagram showing a side view of parts of a multi-compartment container for a dosage element, this diagram shows the parts separated.
Figure 1B:
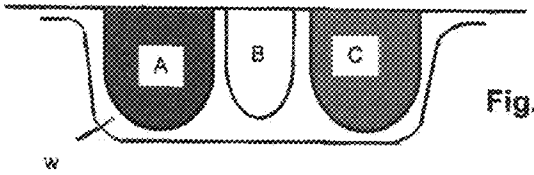
Figure 2:
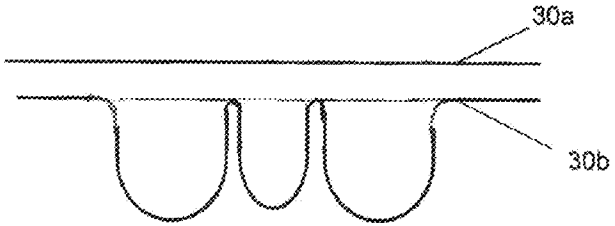
FIG. 2 is a schematic side view showing the formation of a carrier portion 20.

Referring initially to FIGS. 1(*a*) and (*b*), and FIG. 2 there will now be described a dosage element in accordance with an embodiment of the invention and a method of manufacture thereof.

In FIG. 1(*a*) there is shown a two-part dosage element construction comprising a first part 10 which is a shell or skin, and a second part 20 comprising a carrier part comprising a carrier 30 carrying a plurality of compartments 40, 50, 60 containing, respectively, substances A, B and C. All wall materials are water-soluble PVOH.

The first part 10 typically comprises a water soluble receptacle which, when brought together with the second part 20 as shown in FIG. 1(*b*), and subsequently bonded to it, adds rigidity to the thereby formed dosage element.

The first part 10 may be around 20-30 μm thick.

The second part 20 typically comprises first and second elements 30*a* and 30*b* that are combined to give the formation shown in FIG. 1(*a*). The first element 30*a*, as shown in FIG. 2, comprises a sheet like substrate, whilst the second element 30*b* is a thermoformed element that forms the three compartments 40, 50, 60. This second element 30*b* may be made by sucking a sheet of thermoformable material into a three part mould so as to form the three open compartments shown in FIG. 2. The substances A, B, C may then be injected into the open compartments, prior to making the combined second part 20 by capping and sealing the first element 30*a* over the top of the second element 30*b* to close the compartments 40, 50, 60. The second part 20 may then be lifted from the mould, or the mould dropped away from it, whichever is desired.

Figure 3:
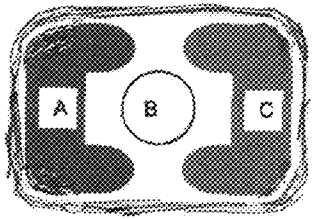
FIG. 3 is a schematic top view of the container of FIGS. 1(*a*) and (*b*) in a consolidated state.
Figure 4:
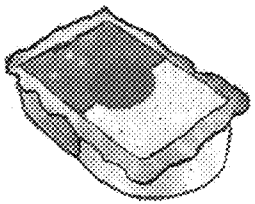
FIG. 4 is a perspective view of a dosage element formed in accordance with an embodiment of the inventive method.

As shown in FIG. 1(*b*), the first part 10 and second part 20 are brought together in a consolidating step and sealed one to another by a convenient process such as heat sealing/crimping to provide a single completed article having the formation as shown in FIGS. 3 and 4.

The dosage element formed from the first and second parts is in the shape of a pillow. It is pleasant and feels "squashy" or compliant, rather than "rigid" or box-like. It is shape stable, in the sense that although it can be pressed and manipulated it does not lose its pillow shape. Although in isolation the parts 10, 20 are flexible (in the manner defined earlier) they come together to support each other, and the resulting dosage product is surprisingly robust.

As a consequence of the relatively high stability given by the combination of first and second parts 10, 20 joints between these parts, and weak spots such as curves and corners, are not likely to be damaged by stress.

During the consolidating operation—in which the first and second parts 10, 20 are brought together—the spaces between the side by side compartments 40, 50, 60 collapse to provide a very compact finished product. The thereby closely fitting water soluble skin provided by first part 10 not only blocks bending of the second part 20, but also provides support to potential weak spots such as that illustrated as "w" in FIG. 1(*b*).

Whilst the method of forming a dosage element has been described in relation to a single tablet, it will be appreciated that a large plurality of such tablets are manufactured in one forming operation.

The preferred process, in detail, for forming dosage elements is as described below in steps (A) through (H).

(A) Forming the element 30*b* into a three chambered pocket, by thermoforming in the cavity of a thermoforming primary mould. A suitable forming temperature for PVOH is, for example, 120° C. The thickness of the film used to produce the pocket is preferably 90 to 120 μm. A suitable forming vacuum is 0 to 2 kPa. The primary mould geometry is such designed that it forms an independent multi-chambered article.

(B) Introducing the contents in the chambers formed by the element 30*b* (bottom film) into the pocket.

(C) Adding the element 30*a* (top film, or lid) to the mould. The thickness of the covering film is generally 60 to 75 μm.

(D) Sealing the first and second elements 30*a*, 30*b* together. The films may be sealed together by any suitable means, for example by means of an adhesive or by heat sealing. Other methods of sealing include infra-red, radio frequency, ultrasonic, laser, solvent (such as water), vibration and spin welding. An adhesive such as an aqueous solution of PVOH may also be used. The seal desirably is water-soluble if the containers are water-soluble. If heat sealing is used, a suitable sealing temperature is for example 125° C. A suitable sealing pressure is especially 500 to 700 kPa depending on the heat sealing machine used.

(E) Forming the first part 10 (second bottom film) into a pocket, by thermoforming in the cavity of a second thermoforming mould. A suitable forming temperature for PVOH is, for example, 120° C. The thickness of the film used to produce the pocket is preferably 60 to 75 μm. A suitable forming vacuum is 0 to 2 kPa. The mould geometry is such designed that it forms a chamber able to tightly wrap the second part 20 tightly.

(F) Adding and tightly placing the intermediate product formed of second part 20 (made of first and second elements 30*a*, 30*b*) to the secondary mould.

(G) Sealing the first part 10 to the second part 20. The films forming the parts may be sealed together by means of an aqueous solution of PVOH, acting as an adhesive. Alternatively they may be sealed together by any other suitable means, for example by means of a further adhesive or by heat sealing. Other methods of sealing include infra-red, radio frequency, ultrasonic, laser, solvent (such as water), vibration and spin welding. If heat sealing is used, a suitable sealing temperature is for example 125° C. A suitable sealing pressure is readily selected by the person skilled in the art.

(H) Cutting to form the final water-soluble article.

It will further be understood by the skilled man that the second part 20, whilst described as being formed from separate sheets 30*a*, 30*b*, could instead be formed from a single substrate onto which individual cores comprising materials A, B, C are directly or indirectly adhered.

Whether a single substrate is used, or a combination of sheets as described earlier are used, the preferred thickness of carrier (substrate OR first element 30*a*) may be within the range of 20-30 μm where the substances A, B, C comprise a combination of powders, or may be up to around 60 μm where A, B or C comprise a gel. This compares favourably with other products which typically require thicker materials of between 300 and 800 μm to ensure a stable product.

Suitable chemical compositions are as follows. In these examples A and C denote compositions in compartments in the first part and B denotes a composition in a compartment in the second part (see FIG. 1).

EXAMPLE 1

Phosphate-containing composition having percarbonate in a separate compartment (Table 1 below) for use in an automatic dishwasher.

TABLE 1

| Raw Material | Powder (8.4 g) | Gel (6.4 g) | Percarb. (1.3 g) | Walls - PVOH (0.4 g) |
|---|---|---|---|---|
| Sodium tripolyphosphate | 42.50 | | | |
| Sodium carbonate | 16.00 | | | |
| Tri-sodium citrate | 22.00 | | | |
| Phosphate speckles | 4.00 | | | |
| Benzotriazol | 0.40 | | | |
| HEDP 4 Na (88.5%) | 0.30 | | | |
| Protease[1] | 1.50 | | | |
| Amylase[1] | 1.00 | | | |
| TAED | 6.20 | | | |
| 1,2-Propylenediglycol | 0.98 | | | |
| Dye | 0.02 | | | |
| Perfume | 0.10 | | | |
| Sulfonated polymer[2] | 5.00 | | | |
| Sulfonated polymer[2] | | 5.00 | | |
| Surfactant[3] | | 24.00 | | |
| Polyglycol[4] | | 9.00 | | |
| 1,2-Propylendiglycol | | 1.00 | | |
| Dye | | 0.03 | | |
| Antifoam[5] | | 0.25 | | |
| TAED | | 3.00 | | |
| Sodium tripolyphoshate | | 57.42 | | |
| Polyglycol 6000 | | 0.30 | | |
| Sodium percarbonate | | | 100 | |
| PVOH (substrate, pockets)[7] | | | | 60 |
| PVOH (lids)[8] | 100 | | | 40 |
| | 100 | 100 | 100 | 100 |

EXAMPLE 2

Phosphate-containing composition having PAP (phthalimidohexanoic acid) (Table 2 below) in a separate compartment for use in an automatic dishwasher.

TABLE 2

| Raw Material | Powder (8.4 g) | Gel (6.4 g) | PAP (1.3 g) | Walls - PVOH (0.4 g) |
|---|---|---|---|---|
| Sodium tripolyphosphate | 48.70 | | | |
| Sodium carbonate | 16.00 | | | |
| Tri-sodium citrate | 22.00 | | | |
| Phosphate speckles | 4.00 | | | |
| Benzotriazol | 0.40 | | | |
| HEDP 4 Na (88.5%) | 0.30 | | | |
| Protease[1] | 1.50 | | | |
| Amylase[1] | 1.00 | | | |
| 1,2-Propylenediglycol | 0.98 | | | |
| Dye | 0.02 | | | |
| Perfume | 0.10 | | | |
| Sulfonated polymer[2] | 5.00 | | | |
| Sulfonated polymer[2] | | 5.00 | | |
| Surfactant[3] | | 24.00 | | |
| Polyglycol[4] | | 9.00 | | |
| 1,2-Propylendiglycol | | 1.00 | | |
| Dye | | 0.03 | | |
| Antifoam[5] | | 0.25 | | |
| Sodium tripolyphoshate | | 60.42 | | |
| Polyglycol 6000 | | 0.30 | | |
| PAP[6] | | | 100 | |
| PVOH (substrate, pockets)[7] | | | | 60 |
| PVOH (lids)[8] | | | | 40 |
| | 100 | 100 | 100 | 100 |

EXAMPLE 3

Sodium citrate-containing composition having percarbonate in a separate compartment (Table 3 below) for use in an automatic dishwasher.

TABLE 3

| Raw Material | Powder (7.0 g) | Gel (6.4 g) | Percarb. (2.3 g) | Walls - PVOH (0.4 g) |
|---|---|---|---|---|
| Sodium carbonate | 16.00 | | | |
| Tri-sodium citrate | 68.50 | | | |
| Benzotriazol | 0.40 | | | |
| HEDP 4 Na (88.5%) | 0.30 | | | |
| Protease[1] | 1.50 | | | |
| Amylase[1] | 1.00 | | | |
| TAED | 6.20 | | | |
| 1,2-Propylenediglycol | 0.98 | | | |
| Dye | 0.02 | | | |
| Perfume | 0.10 | | | |
| Sulfonated polymer[2] | 5.00 | | | |
| Sulfonated polymer[2] | | 5.00 | | |
| Surfactant[3] | | 24.00 | | |
| Polyglycol[4] | | 9.00 | | |
| 1,2-Propylendiglycol | | 1.00 | | |
| Dye | | 0.03 | | |
| Antifoam[5] | | 0.25 | | |
| TAED | | 3.00 | | |
| Tri-sodium citrate | | 56.72 | | |
| Polyglycol 35000 | | 1.00 | | |
| Sodium percarbonate | | | 100 | |
| PVOH (substrate, pockets)[7] | | | | 60 |
| PVOH (lids)[8] | | | | 40 |
| | 100 | 100 | 100 | 100 |

EXAMPLE 4

Sodium citrate-containing composition having PAP in a separate compartment (Table 4 below) for use in an automatic dishwasher.

TABLE 4

| Raw Material | Powder (7.0 g) | Gel (6.4 g) | PAP (1.3 g) | Walls - PVOH (0.4 g) |
|---|---|---|---|---|
| Sodium carbonate | 16.00 | | | |
| Tri-sodium citrate | 74.70 | | | |
| Benzotriazol | 0.40 | | | |
| HEDP 4 Na (88.5%) | 0.30 | | | |
| Protease[1] | 1.50 | | | |
| Amylase[1] | 1.00 | | | |
| 1,2-Propylenediglycol | 0.98 | | | |

TABLE 4-continued

| Raw Material | Powder (7.0 g) | Gel (6.4 g) | PAP (1.3 g) | Walls - PVOH (0.4 g) |
|---|---|---|---|---|
| Dye | 0.02 | | | |
| Perfume | 0.10 | | | |
| Sulfonated polymer[2] | 5.00 | | | |
| Sulfonated polymer[2] | | 5.00 | | |
| Surfactant[3] | | 24.00 | | |
| Polyglycol[4] | | 9.00 | | |
| 1,2-Propylendiglycol | | 1.00 | | |
| Dye | | 0.03 | | |
| Antifoam[5] | | 0.25 | | |
| Tri-sodium citrate | | 59.72 | | |
| Polyglycol 35000 | | 1.00 | | |
| PAP[6] | | | 100 | |
| PVOH (substrate, pockets)[7] | | | | 60 |
| PVOH (lids)[8] | | | | 40 |
| | 100 | 100 | 100 | 100 |

EXAMPLE 5

MGDA-containing composition having PAP in a separate compartment (Table 5 below) for use in an automatic dishwasher.

TABLE 5

| Raw Material | A - Powder (6.0 g) | C - Gel (6.4 g) | B - PAP (1.3 g) | Walls - PVOH (0.4 g) |
|---|---|---|---|---|
| Sodium carbonate | 16.00 | | | |
| MGDA granules[9] | 74.70 | | | |
| Benzotriazol | 0.40 | | | |
| HEDP 4 Na (88.5%) | 0.30 | | | |
| Protease[1] | 1.50 | | | |
| Amylase[1] | 1.00 | | | |
| 1,2-Propylenediglycol | 0.98 | | | |
| Dye | 0.02 | | | |
| Perfume | 0.10 | | | |
| Sulfonated polymer[2] | 5.00 | | | |
| Sulfonated polymer[2] | | 5.00 | | |
| Surfactant[3] | | 24.00 | | |
| Polyglycol[4] | | 9.00 | | |
| 1,2-Propylendiglycol | | 1.00 | | |
| Dye | | 0.03 | | |
| Antifoam[5] | | 0.25 | | |
| MGDA granules[9] | | 60.22 | | |
| Polyglycol 6000 | | 0.50 | | |
| PAP[6] | | | 100 | |
| PVOH (substrate, pockets)[7] | | | | 60 |
| PVOH (lids)[8] | | | | 40 |
| | 100 | 100 | 100 | 100 |

EXAMPLE 6

Sodium citrate-containing composition having PAP in a separate compartment (Table 6 below) for use in an automatic dishwasher.

TABLE 6

| Raw Material | A - Powder (7.0 g) | C - Powder (7.0 g) | B - PAP (1.3 g) | Walls - PVOH (0.4 g) |
|---|---|---|---|---|
| Sodium carbonate | 17.00 | 17.50 | | |
| Tri-sodium citrate | 68.50 | 68.50 | | |
| Benzotriazol | 0.40 | 0.40 | | |

TABLE 6-continued

| Raw Material | A - Powder (7.0 g) | C - Powder (7.0 g) | B - PAP (1.3 g) | Walls - PVOH (0.4 g) |
|---|---|---|---|---|
| HEDP 4 Na (88.5%) | 0.30 | 0.30 | | |
| Protease[1] | 1.50 | | | |
| Amylase[1] | | 1.00 | | |
| TAED | 6.20 | 6.20 | | |
| 1,2-Propylenediglycol | 0.98 | 0.98 | | |
| Dye | 0.02 | 0.02 | | |
| Perfume | 0.10 | 0.10 | | |
| Sulfonated polymer[2] | 5.00 | 5.00 | | |
| Sodium percarbonate | | | 100 | |
| PVOH (substrate, pockets)[7] | | | | 60 |
| PVOH (lids)[8] | | | | 40 |
| | 100 | 100 | 100 | 100 |

In the above composition examples parts are by weight, and the following footnotes apply.

1 Granules which contain approx. 3-10% active enzyme
2 AMPS co-polymer
3 Non-ionic low foaming surfactant
4 Mixed poly alkoxylate grade, P 41/12000, Clariant
5 Silicon oil
6 PAP with particle size (Q50%<15 μm)
7 PVOH foil, 90 μm, PT grade from Aicello
8 PVOH foil, 60 μm, PT grade from Aicello
9 Sodium salt of methyl-glycine-diacetic acid The container used in this example has 3 compartments separated from each other. In one compartment the PAP composition or the percarbonate composition is filled, respectively.

The powder is introduced into the powder compartment. The gel mixture is heated to 65° C. and stirred for 20 min. Then the gel is introduced into the gel compartment and is allowed to cool. Finally the compartments are sealed with PVOH film.

In the example the particle size of the PAP has preferably a size of 0.01-100 μm (Q50%<15 μm).

In all examples above illustrating the present invention the dosage element is consumed in a washing cycle, in the sense that at the end of cycle no part of it has to be removed from the machine; indeed no part of it can be discerned, within the machine.

Whilst three substances are discussed, the skilled man will realise that, according to a particular function to be performed, more or fewer substances may be utilised and combined in any logical combination without departing from the principles of the present invention.

Optionally, the dosage element may further comprise a third part comprising a water soluble lidding film, which can be included to further protect the dosage element prior to use and to provide it with extra rigidity.

The dosage element as described above provides a very convenient and compact arrangement that is easy to manufacture, and subsequently which is resistant to bending and other stress.

The invention claimed is:

1. A ware washing dosage element that is consumable in a ware washing process, said element comprising: first and second joined parts, wherein the second part comprises a substrate carrying a plurality of substances arranged in side by side relation, and wherein the first part comprises a receptacle that tightly encloses said substances within the said receptacle.

2. The dosage element according to claim 1 which is a dishwashing dosage element.

3. The dosage element of claim 1, wherein the first part is empty and substantially the entire active washing content of the dosage element is conveyed via the substances in the second part.

4. A ware washing dosage element that is consumable in a ware washing process, said element comprising first and second joined parts, wherein said second part comprises a substrate carrying a plurality of compartments arranged in a side by side relation each of which compartments independently contains a substance wherein said first part comprises a receptacle that tightly encloses said plurality of compartments.

5. A method of manufacturing a ware washing dosage element that is consumable in a ware washing process, said method comprising the steps of:

(a) forming a first part into an open receptacle;

(b) forming a second part into a substrate carrying a plurality of substances arranged in side by side relation; and (c) closing said open receptacle of said first part by joining the first and second parts to one another to enclose said substances within said first and second parts;

wherein, in the dosage element formed, the first part comprises a chamber that tightly embraces the substances of the second part.

6. The method of claim 5, wherein said step (b) further comprises the sub-steps of: (b1) forming a multi-chambered pocket; (b2) introducing said substances to chambers of said pocket; and (b3) closing said chambers with a top film.

7. The method according to claim 5, wherein in said step (c) the first part is sealed to the second part.

8. A dosage element manufactured by the method of claim 5.

9. A method of ware washing, comprising the steps of:

providing a dosage element according to claim 8 to an automatic dishwasher, providing wares to the automatic dishwasher, operating the automatic dishwasher.

10. The method of claim 5, wherein said first part and said second part are relatively flexible in isolation, but their joining to one another in step (c) results in the dosage element formed being relatively shape-stable.

11. The method of claim 5, wherein in step (b), the second part is formed into a substrate carrying a plurality of substances arranged in spaced apart relation.

12. The method of claim 5, wherein the first part is thermoformed.

13. The method of claim 5, wherein the second part is thermoformed.

14. A method of manufacturing a ware washing dosage element that is consumable in a ware washing process, said method comprising the steps of:

(a) forming a first part into an open receptacle (b) forming a second part into a substrate carrying a plurality of mutually separated substances arranged in side by side relation; and (c) closing said open receptacle of said first part by joining the first and second parts to one another to enclose said substances within said first and second parts, wherein the method is adapted such that, in said joining step, spaces between said substances become substantially taken up by substances coming together under compressive forces.

* * * * *